US006593839B2

(12) United States Patent
Nakayama et al.

(10) Patent No.: US 6,593,839 B2
(45) Date of Patent: Jul. 15, 2003

(54) LEAKAGE FLUX-TYPE POWER CONVERSION TRANSFORMER

(75) Inventors: Kazuhiro Nakayama, Tsurugashima (JP); Shigeo Abe, Tsurugashima (JP)

(73) Assignee: Toko Kabushiki Kaisha, Tokyo-To (JP)

( * ) Notice: Subject to any disclaimer, the term of this patent is extended or adjusted under 35 U.S.C. 154(b) by 39 days.

(21) Appl. No.: 10/034,112

(22) Filed: Jan. 3, 2002

(65) Prior Publication Data

US 2002/0093410 A1 Jul. 18, 2002

(30) Foreign Application Priority Data

Jan. 12, 2001 (JP) ..... 2001-004557

(51) Int. Cl.[7] ..... H01F 27/24
(52) U.S. Cl. ..... 336/182; 336/178; 336/212
(58) Field of Search ..... 336/182, 174, 336/178, 212; 174/27

(56) References Cited

U.S. PATENT DOCUMENTS 4,321,426 A * 3/1982 Schaeffer et al. ..... 174/34
5,557,698 A * 9/1996 Gareis et al. ..... 385/101
6,445,270 B1 * 9/2002 Ogasawara ..... 336/182

* cited by examiner

*Primary Examiner*—Anh Mai
(74) *Attorney, Agent, or Firm*—Pillsbury Winthrop LLP

(57) ABSTRACT

A conventional braided wire has high direct current resistance and high winding resistance in high-frequency regions, making it impossible to achieve a power conversion transformer having sufficient conversion efficiency. In the present invention, a braided wire is braided from three or more cluster wires, each comprising multiple strands, and is used as winding material for a leakage flux-type power conversion transformer. The braid pitch of the braided wire is set so that the ratio between one-turn winding length and the braid pitch is between 0.5 and 2.5.

4 Claims, 4 Drawing Sheets

LEAKAGE FLUX-TYPE POWER CONVERSION TRANSFORMER

BACKGROUND OF THE INVENTION

1. Field of the Invention

The present invention relates to a leakage flux-type power conversion transformer which is used in a resonance inverter of a cold cathode tube illumination device, and in resonance converters such as a switching power supply and a non-contact charger. More specifically, the invention relates to the constitution of a power conversion transformer having a comparatively large output which uses braided wires as windings.

2. Description of the Related Art

As many types of electrical devices are being miniaturized, there is a strong demand to improve the power apparatuses for these devices by miniaturizing them, increasing their frequency and power conversion efficiency, reducing their noise levels, and so on. A resonance circuit system is generally used to achieve this. The resonance circuit system employs a method of zero bolt switching or zero current switching, which are characterized by high efficiency and low noise levels. The resonance circuit system mainly uses leakage inductance of a power conversion transformer, and provides a wide gap between the magnetic circuits of the primary winding and the secondary winding. (Hereinafter, a power conversion transformer having such a magnetic circuit constitution will be termed a "leakage flux-type power conversion transformer".)

In a power conversion transformer for a non-contact charger which transmits power by electromagnetic induction, a primary winding is provided on the charger side and a secondary winding is provided on the cordless device side. Since the primary winding and secondary winding are separated for functional reasons, there is a wide gap between their magnetic circuits, obtaining a leakage flux-type power conversion transformer. For this reason, the resonance circuit system is also used in the non-contact charger. A resonance converter is constituted by combining the leakage inductance element of the power conversion transformer with a capacitor, and power is transmitted from the primary winding to the secondary winding by high-frequency oscillation.

FIG. 5 shows one example of a power conversion transformer for a non-contact charger. Reference code 10 represents the transmitting side, and reference code 20 represents the receiving side (cordless device side). The two bobbins 12 of the transmitting side 10 comprise winding axes 12*a* which are cylindrical in cross-section, as shown in FIG. 6. A primary winding 13 is wound around each of the winding axes 12*a*. The lead wires of the primary winding 13 are connected to terminals 11, attached to the bobbins 12. The two primary windings 13 are connected in series via the terminals 11 and an un-illustrated conductive pattern of a printed substrate. Reference code 15 represents a core comprising a U-shaped magnetic substance having two legs 15*a*. The two bobbins 12 are secured to the core 15 by inserting the legs 15*a* into holes in the winding axes 12*a*.

The receiving side 20 has a similar constitution. Primary windings 23 are wound around winding axes 22*a* of two bobbins 22, which terminals 21 are attached to. The two primary windings 23 are connected in series via the terminals 21 and an un-illustrated conductive pattern of a printed substrate. Reference code 25 represents a core comprising a U-shaped magnetic substance having two legs 25*a*. The two bobbins 22 are secured to the core 25 by inserting the legs 25*a* into holes in the winding axes 22*a*.

Litz (Litzendraht) wire is made by bundling together and twisting insulated single wires (hereinafter termed "strands"), and is used as the wire material for the windings in the above power conversion transformer. By using Litzwire, it is possible to reduce the skin effect, whereby current density deviates toward the surface of the strand as a result of the magnetic field generated by its own high-frequency current, and eddy current loss known as proximity effect, which is caused by magnetic flux leaked from other strands. However, when used in a power conversion transformer which requires a comparatively large output, the Litz wire cannot be not sufficiently twisted due to the great number of strands it comprises. When this type of Litz wire is used as the winding wire of the leakage flux-type power conversion transformer, some strands are wound near the surface of the core and some are wound near the gap, leading to variation in the inductance values of the strands. As a result of electromagnetic coupling between the strands, when a high frequency current is passed through them, the current concentrates in the strands having smaller inductance, consequently increasing the winding loss and making it difficult to improve the efficiency of the transformer.

Accordingly, a braided wire may conceivably be used, since in a braided wire there is little positional deviation of the strands even when a great number of them are provided. FIG. 7 shows an example constitution of a braided wire 30, in which multiple cluster wires 31, each comprising multiple strands 31*a* arranged in a horizontal row, are braided together. The cluster wires 31 of the braided wire 30 are braided together while changing their positions evenly in the up, down, left, and right directions. Therefore, the positions of the cluster wires 31 and the strands 31*a* deviate much less than in a Litz wire. As a result, there is less variation in the inductance values of the strands 31*a*. Increase in the winding loss, caused by the concentration of current in the strands with smaller inductance, is thereby reduced.

However, the conventional braided wire 30 is braided in a spiral at a narrow braid pitch, such as in the external shield wire section of a coaxial cable. Since the length of the strands 31*a* greatly exceeds the actual length of the braided wire 30, the direct current resistance is greater than in a Litz wire. Further, since the width of a braided wire having a narrow braid pitch increases, when multiple wires are wound around the winding axis, the portions were the wires overlap each other increases. At this time, the magnetic flux interlinkage increases as far as the inner layer, producing a strong skin effect and increasing the winding resistance at high frequencies. Since the direct current resistance and the winding resistance at high frequencies increase, it has not been possible to obtain a power conversion transformer with sufficient conversion efficiency by using the conventional braided wire 30.

SUMMARY OF THE INVENTION

The leakage flux-type power conversion transformer of the present invention comprises a first core having a leg; a second core having a leg; a primary winding, which is wound around the leg of the first core; and a secondary winding, which is wound around the leg of the second core. The primary winding and the secondary winding are electromagnetically coupled together. At least one gap is provided between the leg of the first core and the leg of the second core. At least one of the primary winding and the secondary winding comprises a braided wire, which is braided from three or more cluster wires, each comprising a plurality of wire strands. The size of the braid pitch (P) of the braided wire is such that the ratio (W/P) between the average one-turn winding length (W) of the strands and the braid pitch (P) is between 0.5 and 2.5.

DESCRIPTION OF THE PREFERRED EMBODIMENTS

Figure 1:
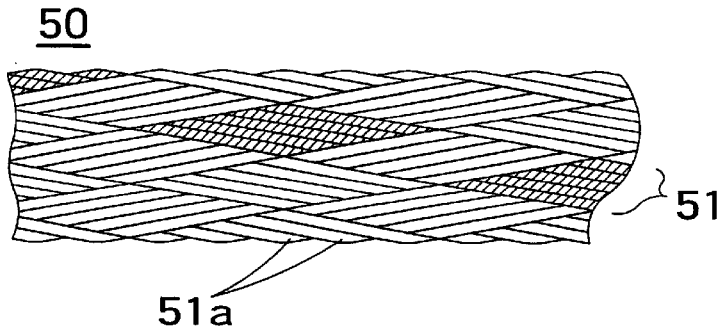
FIG. 1 is an enlarged plan view of an embodiment of a braided wire in the present invention.
Figure 6:
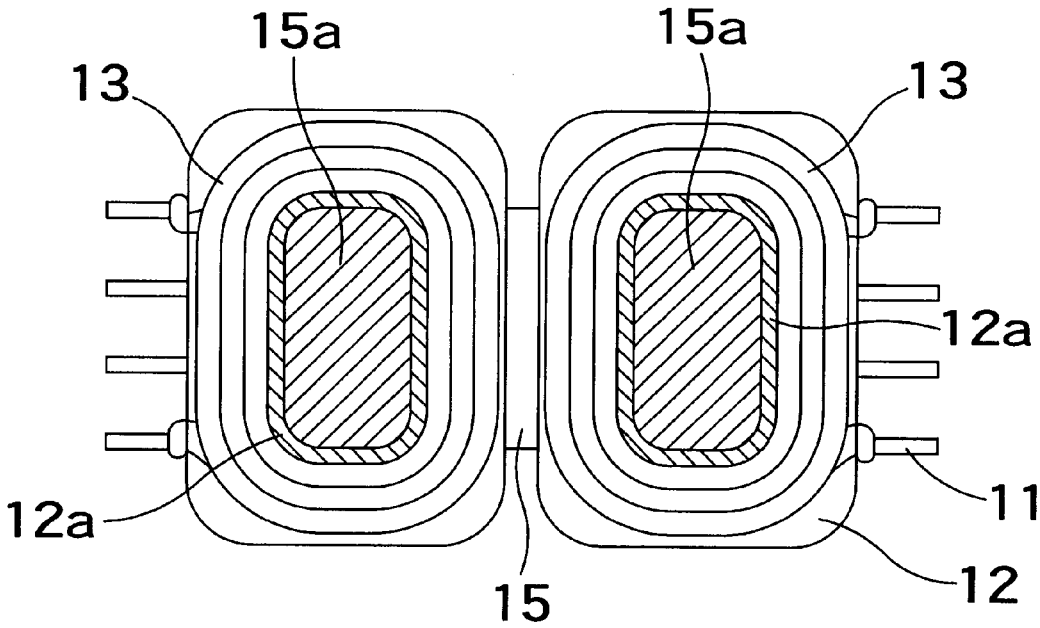
FIG. 6 is a cross-sectional view taken along the line 6—6 of FIG. 5.
Figure 7:
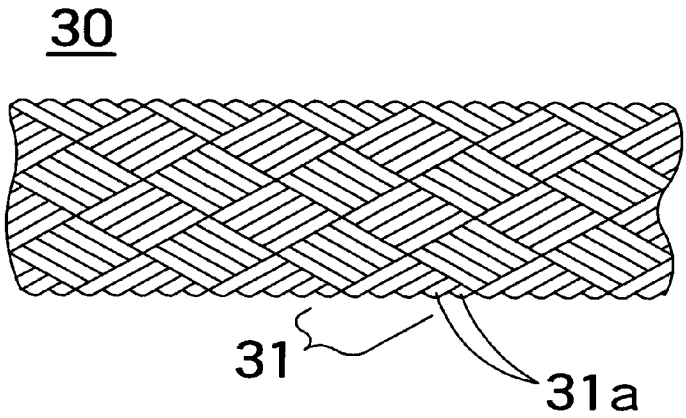
FIG. 7 is an enlarged plan view of a conventional braided wire.

FIG. 1 shows an embodiment of a braided wire 50 which is used as the winding wire material in the leakage flux-type power conversion transformer of the present invention. The braided wire 50 comprises multiple cluster wires 51, each comprising five strands 51*a* which are arranged in horizontal rows; the cluster wires 51 are braided in a cylindrical shape and pressed together to form a compressed flat braided wire. The braided wire 50 differs from the conventional braided wire shown in FIG. 6 in respect of the fact that its braid pitch (the distance of one cycle of positional change of the cluster wires 51) is much longer.

Figure 2:
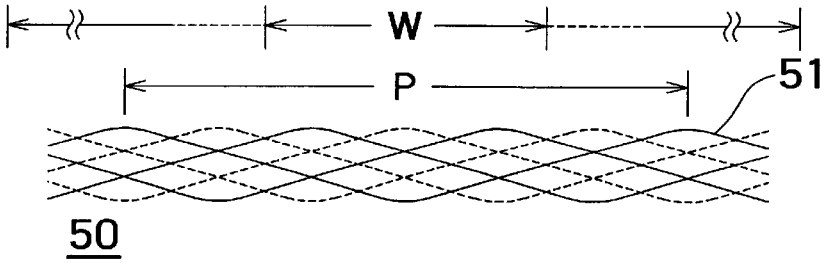
FIG. 2 is a simplified schematic view of a constitution of a braided wire.

FIG. 2 shows a simplified constitution of the braided wire 50, which here comprises three cluster wires 51. In FIG. 2, the single thick solid line and the thin broken lines each represent the cluster wires 51. The positions of the three cluster wires 51 change systematically as they are braided together. When the length of one wind of the braided wire 50 when wound around the winding axis 12*a* (FIG. 6) and the like is expressed as one-turn winding length W, the braid pitch P of the braided wire 50 is selected so that the ratio (W/P) between the one-turn winding length W and the pitch P is a value between 0.5 and 2.5. Incidentally, when the braided wire 50 is wound into a great number of layers, an average of the one-turn wind lengths is used as the one-turn wind length W.

Figure 5:
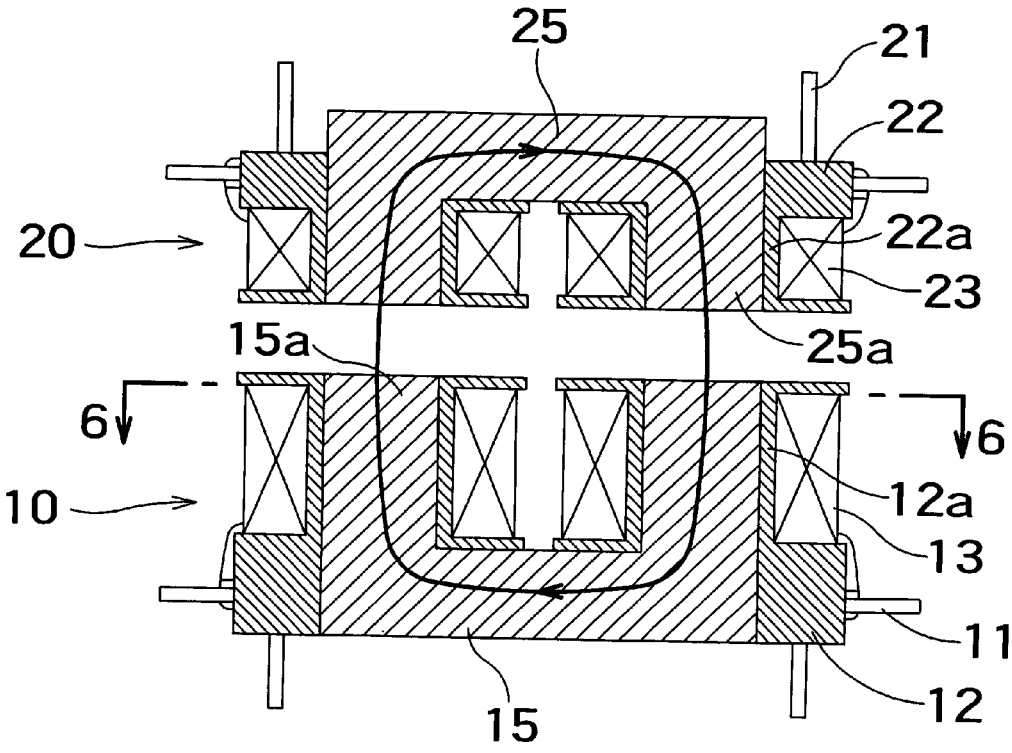
FIG. 5 is a front cross-sectional view of one example of a power conversion transformer.
Figure 8:
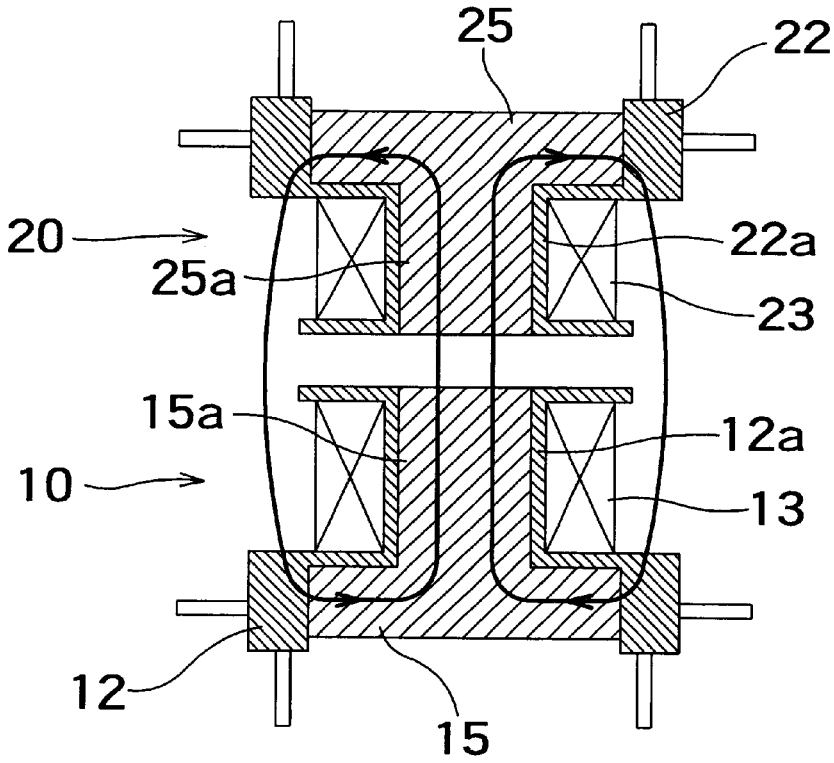
FIG. 8 is a front cross-sectional view of a second embodiment of a power conversion transformer.

The leakage flux-type power conversion transformer of the present invention is characterized in that it uses this type of braided wire 50 as the material for at least one of the primary winding and the secondary winding. The present invention can similarly be applied in a power conversion transformer for a non-contact charger having a simplified constitution such as that shown in FIG. 8. In FIG. 8, the sections corresponding to those in FIG. 5 are represented by the same reference codes, reference code 10 representing the transmitting side, and reference code 20, the receiving side. A primary winding 13 is wound around a winding axis 12*a* of a bobbin 12 of the transmitting side 10, and a secondary winding 23 is wound around a winding axis 22*a* of a bobbin 22 of the receiving side 20. Reference codes 15 and 25 represent cores having legs 15*a* and 25*a*.

Figure 9:
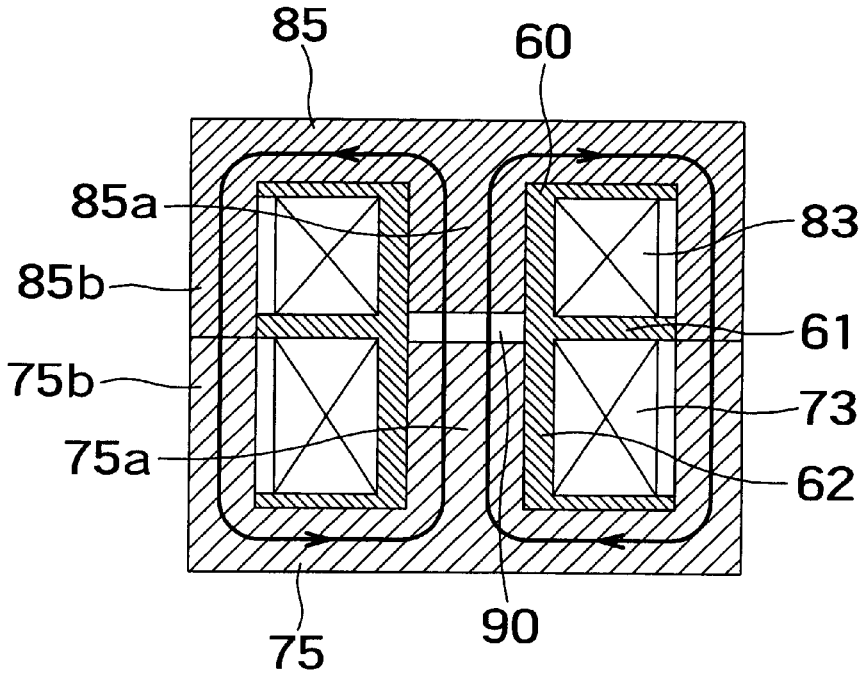
FIG. 9 is a front cross-sectional view of a third embodiment of a power conversion transformer.

The present invention can also be applied in a power conversion transformer for an inverter or a converter, as shown in FIG. 9. This transformer comprises one bobbin 60 and two E-shaped cores 75 and 85. Two winding grooves are divided by three teeth 61, and are provided in the cylindrical winding axis 62 of the bobbin 60. A primary winding 73 is wound in one of the grooves, and a secondary winding 83 is wound in the other. Central legs 75*a* and 85*a* of the cores 75 and 85 respectively are inserted from opposite directions into a hole in the winding axis 62, and face each other with a gap 90 therebetween. The outer legs 75*b* and 85*b* of the cores 75 and 85 contact each other face to face.

Figure 3:
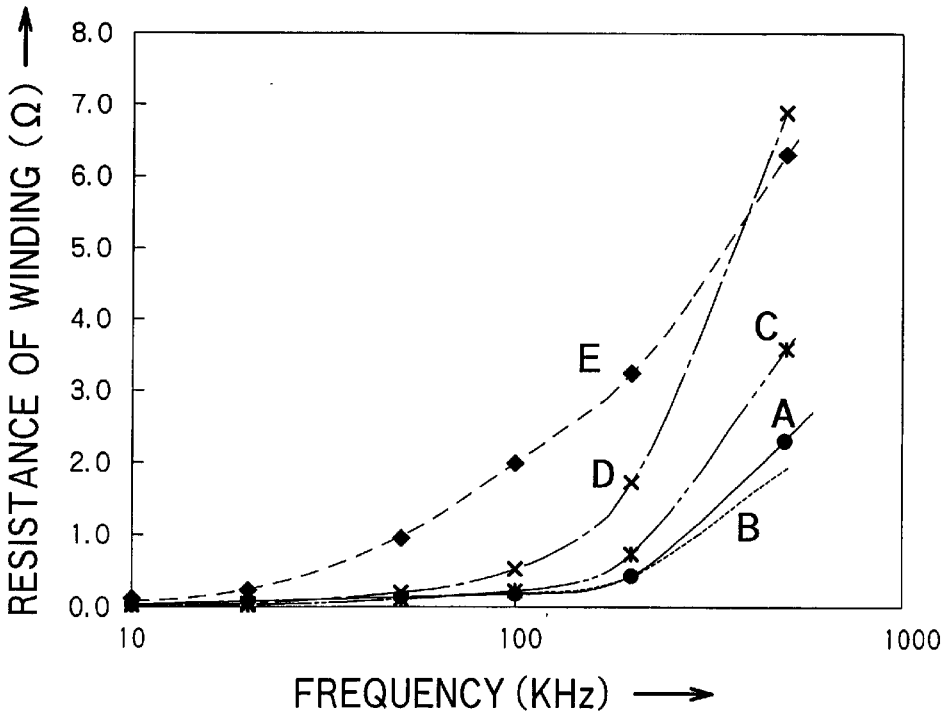
FIG. 3 is a diagram showing frequency characteristics of winding resistance.

Transformers of the constitution shown in FIG. 9 were made using four types of braided wires having different braid pitches and a completely non-braided bundle wire, the wires being wound the same number of windings (eighteen turns) on the primary winding side in each case. FIG. 3 shows measurements obtained when the high-frequency winding resistance of the primary side was measured while varying the frequency. The average one-turn winding length W of each winding was approximately 52 mm; the diameter (0.08) of the strands forming each wire, and the number of strands (96), were the same in each case. The gap 90 between the core 75 and the core 85 is 0.7 mm.

In FIG. 3, the one-dotted chain line D represents the characteristics obtained when using the conventional braided wire 30 having a braid pitch of 17 mm. As shown in FIG. 3, the winding resistance increases markedly as the frequency rises. The ratio (W/P) between the one-turn winding length W and the braid pitch P at this time is approximately 3. The broken line E represents the characteristics when using the completely non-braided bundle wire, and the winding resistance is increasing even further than the one-dotted chain line D at below approximately 300 KHz. The ratio (W/P) at this time may be regarded as almost zero.

The solid line A, the dotted line B, and the two-dotted chain line C represent embodiments of the present invention, and show the characteristics when using braided wires having pitches of, respectively, 24 mm, 50 mm, and 100 mm. The ratio between the one-turn winding length W and the braid pitch P (W/P) in each of the above cases is approximately 2, 1, and 0.5 respectively. In each case, the winding resistance in the high-frequency region increases far less than the one-dotted chain line D and the broken line E.

Figure 4:
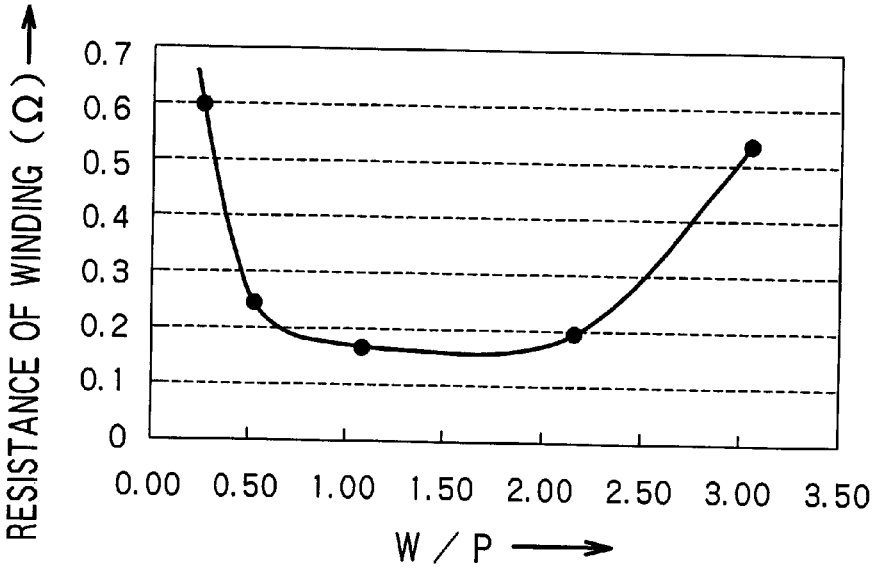
FIG. 4 is a diagram showing the relationship between the ratio (W/P) and resistance of winding.

FIG. 4 shows measurements obtained when braided wires having different braid pitches were tested at a normal operating frequency of 100 KHz, and the relationship between the ratio (W/P) and the winding resistance was measured. As is clear from FIG. 4, when the ratio (W/P) between the one-turn winding length W and the braid pitch P is less than 0.5 or greater than 2.5, the winding resistance increases markedly. The braid pitch P of the braided wire should be selected so that the ratio (W/P) between the one-turn winding length W and the braid pitch P is between 0.5 and 2.5. More preferably, the braid pitch P should such that the ratio (W/P) is between 1 and 2.

To ensure that the ratio (W/P) is between 0.5 and 2.5, considering the one-turn winding length W as a reference, the size of the braid pitch P should be 0.4 to 2.0 times that of the one-turn winding length W. When the braid pitch P of the braided wire is smaller or greater than this, the winding resistance in the high-frequency region increases. The smaller the braid pitch P, the longer the strands which are used, increasing the number of braids and consequently increasing the cost. When the braid pitch P is too large, the positional relationship between the strands becomes distorted and liable to unwind, making the winding operation difficult.

In the present invention, braided wires are used as the winding material, and the most suitable braid pitch is selected for one-turn winding length of the winding section of the transformer. According to the invention, there is little variation in the inductance between the strands, and the length of the strands can be reduced to a minimum, thereby reducing direct current resistance. Consequently, increase in the winding resistance in the high-frequency region can be curtailed, reducing winding loss and achieving a power conversion transformer having extremely good conversion efficiency. Particularly noticeable advantages are obtained when the invention is applied to a large-output leakage flux-type power conversion transformer for high-frequency.

What is claimed is:

1. A leakage flux-type power conversion transformer comprising:

a first core having a leg;

a second core having a leg;

a primary winding, wound around the leg of the first core; and a secondary winding, wound around the leg of the second core;

said primary winding and said secondary winding being electro-magnetically coupled together;

at least one gap being provided between the leg of said first core and the leg of said second core;

at least one of said primary winding and said secondary winding comprising a braided wire, braided from three or more cluster wires, each comprising a plurality of strands; and the size of the braid pitch (P) of the braided wire being such that the ratio (W/P) between the average one-turn winding length W of said strands and the braid pitch (P) is between 0.5 and 2.5.

2. The leakage flux-type power conversion transformer as described in claim 1, wherein the braid pitch (P) of the braided wire is such that the ratio (W/P) between the average one-turn winding length W of said strands and the braid pitch (P) is a value of between 1 and 2.

3. The leakage flux-type power conversion transformer as described in claim 1, further comprising a first bobbin having a cylindrical winding, which the leg of said first core is inserted to, and a second bobbin having a cylindrical winding, which the leg of said second core is inserted to; the primary winding being wound around the winding axis of said first bobbin, and the secondary winding being wound around the winding axis of said second bobbin.

4. The leakage flux-type power conversion transformer as described in claim 1, further comprising a bobbin having a cylindrical winding axis, which two winding grooves are provided in, the primary winding being wound in one of said grooves and the secondary winding being wound in another of said grooves;

the leg of said first core and the leg of said second core being inserted from opposite directions into said winding axis and facing each other with said gap therebetween.

* * * * *